United States Patent [19]

Fawcett

[11] 4,177,956

[45] Dec. 11, 1979

[54] COMMINUTION MACHINE WITH PULVERIZING BLADE ASSEMBLY

[75] Inventor: William E. Fawcett, Latrobe, Pa.

[73] Assignee: Kennametal Inc., Latrobe, Pa.

[21] Appl. No.: 890,530

[22] Filed: Mar. 27, 1978

[51] Int. Cl.[2] ..... B02C 13/28

[52] U.S. Cl. ..... 241/188 A; 29/447; 241/191; 241/197

[58] Field of Search ..... 241/188 R, 188 A, 191, 241/197; 29/447

[56] References Cited

U.S. PATENT DOCUMENTS

| | | | |
|---|---|---|---|
| 1,811,438 | 6/1931 | Riley et al. | 241/191 X |
| 2,013,800 | 9/1935 | Daniels | 241/188 A X |
| 2,539,056 | 1/1951 | Brown | 29/447 |
| 3,157,366 | 11/1964 | Rogers | 241/188 R |
| 3,193,918 | 7/1965 | Heldenbrand | 29/447 |
| 3,740,839 | 6/1973 | Otte et al. | 29/447 UX |
| 4,113,191 | 9/1978 | Wattles et al. | 241/188 A |

*Primary Examiner*—Howard N. Goldberg
*Attorney, Agent, or Firm*—Lawrence R. Burns

[57] ABSTRACT

A comminution device having replaceable blade assemblies which are used, preferably, as stators. The blade assemblies can be replaceably affixed to the housing of the machine when used as stators or may be replaceably affixed to a rotating arm when used as rotors. The blade assemblies are comprised of a plug member that may have threads on part of its outer periphery in order to be threadedly connected to a stationary housing or rotatable member of a machine. A slotted portion is formed in the plug member and one end of a cemented hard metal carbide blade is disposed in said slotted portion. A collar is shrunk fit over the periphery of the slotted portion and provides the clamping force necessary to hold the blade in assembled relation to the plug member. Tapering cooperating elements of abutment are provided between the walls of the slot and the sides of the blade in order to urge one end of the blade into firm contact with the bottom of the slotted portion.

7 Claims, 5 Drawing Figures

COMMINUTION MACHINE WITH PULVERIZING BLADE ASSEMBLY

BACKGROUND OF THE INVENTION

This invention relates to comminution devices or pulverizing machines which use rotors and stators located within a housing to pulverize certain materials. Such machines usually have a pulverant inlet means, a pulverant outlet means utilizing the rotor members to impart velocity to the pulverant material so that impact on the stator members reduces the particle size of the pulverant material.

In such machines, wear on the stators and rotors is an extreme problem and the use of a hard wear resistant material, such as a cemented hard metal carbide material, is desirable. Such material has found use in certain types of comminution machines; see, for example, U.S. Pat. No. 3,995,782, granted to applicants' corporation.

Early pulverizing blade assemblies have been made comprising a hard cemented metal carbide blade and a plug member. The blade, however, was butt welded to one end of the member. The plug member was then threadedly held in the housing of a pulverizing device so that the stator blades extended so as to cooperate with the rotors in pulverizing material.

The problem in such early brazed cemented hard metal carbide pulverizing blade assemblies was that frequent failures occurred due to the residual brazing stresses in the blade. The residual brazing stresses, combined with the impact loading from the material being worked in the machine, could cause premature failure of at least one of the cemented hard metal carbide blades. The failure of one blade was usually enough to cause failure of many more blades within the machine.

BRIEF SUMMARY OF THE INVENTION

According to the present invention, a blade assembly is contemplated for use in comminution or pulverizing type machines. Such type machines usually comprise a housing with a pulverant material inlet, stator means within the housing, and a power driven rotor means cooperating with said stator means to crush the pulverant material.

A pulverant material outlet means is used to remove the finished material from the housing and may even include a vacuum source to aid the material in flowing toward the housing outlet.

Preferably, in such a machine, one of either the stator or rotor means may be comprised of a plug having a slotted portion and a blade having one end disposed in the slotted portion. A collar, preferably metal, may then be sized to fit over the periphery of the slotted portion of the plug so as to hold the blade in the plug in an assembled relation.

The blade is formed preferably of a cemented hard metal carbide material, such as tungsten carbide, while the collar is preferably a cylindrical metal ring which is sized so that it can be shrunk fit over the plug member. The shrunk fit will preferably provide the slotted portion of the plug member with enough clamping force to mechanically hold one end of the blade in assembled relation to the plug.

The slotted portion of the plug is preferably founded by two opposing faces and a bottom face joining the two opposing faces. Preferably, the opposing faces of the slot taper or diverge away from one another as the slot depth extends into the plug.

The blade according to the present invention is rectangular in configuration, having side and end walls, and is preferably tapered on one end, also so that the sides of the blade and the faces of the slotted portion form cooperating elements of abutment means. Preferably, when so tapered, the clamping force of the collar urges the one end of the blade into firm abutment with the bottom face of the slotted portion.

Further, according to the present invention, in comminution machines or pulverizing machines, either the rotor or stator means may comprise the plug blade and collar assembly described. Preferably, however, it is the stator assembly which should be so comprised.

This invention further contemplates the method of making blade assemblies for pulverizing machines, which method comprises the steps of forming a plug member with opposing ends, slotting one of said opposing ends and disposing one end of a hard wear resistant blade in said slotted portion in clamping said plug and said blade in assembled relation by shrink fitting a collar around the periphery of a slotted portion of a plug.

It is an object of the present invention to provide longer lasting blade assemblies in comminution or pulverizing machines.

It is a further object of the present invention to reduce the maintenance necessary for comminution and pulverizing machines.

It is a further object of the present invention to reduce the number of times blade assemblies must be replaced in said machines.

It is a further object of the present invention to provide long lasting, wear resistant and easily replaceable stator blades for comminution or pulverizing devices.

The exact nature of the present invention will become more clearly apparent upon reference to the following detailed specification taken in connection with the accompanying drawings in which.

DETAILED DESCRIPTION OF THE INVENTION

Figure 1:
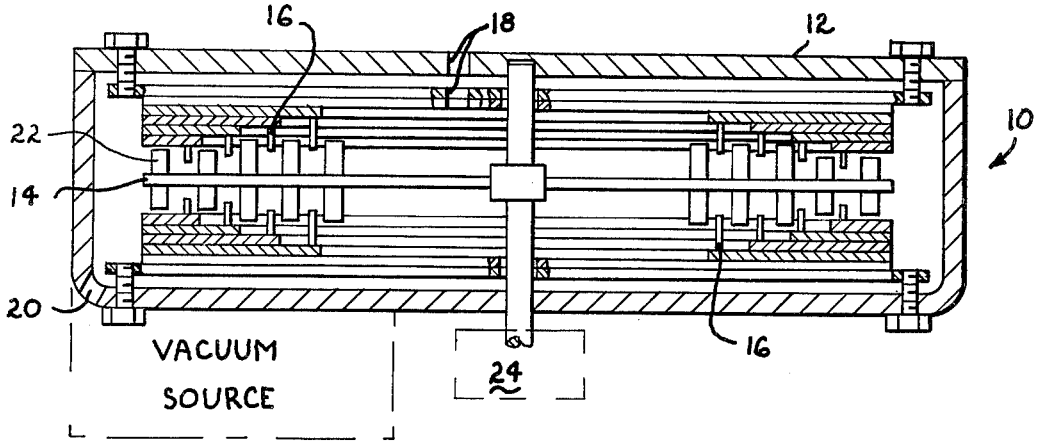
FIG. 1 is a sectional view of a comminution or pulverizing machine according to the present invention.

Referring to the drawings somewhat more in detail, what is shown in FIG. 1 is a comminution or pulverizing machine 10 which is comprised of a housing assembly 12 which surrounds a rotor assembly 14 and stator assemblies 16.

A pulverant inlet line is located as shown by 18 and pulverant material is fed through 18 into the housing assembly 12. Located to one side of the pulverizing machine 10 is an outlet means 20 which is used to withdraw the material once it has been pulverized by the machine.

A vacuum source is sometimes employed around the pulverant outlet means 20 so as to aid in moving the material from inlet means 18 through the pulverizing machine to outlet means 20.

In a pulverizing machine of this type, the rotor assembly 14 has mounted near its outer ends rotors 22 which generally extend in a vertical direction. The rotor assembly 14 is driven in rotation by drive means 24 and is aligned so as to closely cooperate with vertical extending stator members 16.

The pulverant material entering inlet means 18 is accelerated in speed by the rotational motion of rotor assembly 14 until the pulverant material impacts on the vertically extending stators 16 located at various distances from the center of rotor assembly 14. The impact of the pulverant material upon the stators causes a reduction in particle size of the material which is then withdrawn through outlet 20 of the machine.

Figure 2:
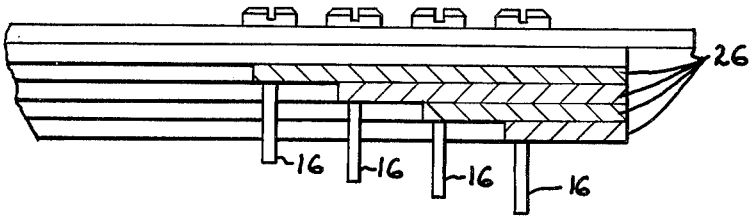
FIG. 2 is an enlarged sectional view of the stator assemblies as they are mounted in a typical machine housing.

Shown in FIG. 2 is an enlarged view of part of the shank of housing assembly 12 of pulverizing machine 10 in which the stator assemblies 16 are located. The housing assembly 12 includes a stack of disc-like members 26, all of which have the same outside diameters but having different side diameters as shown in FIG. 2. The structure of the housing assembly 12 is stepped by these discs 26 as the radial distance from the center of the rotor assembly increases. Replaceably affixed in and vertically extending from the discs 26 of housing assembly 12 are stator assemblies 16.

Figure 3:
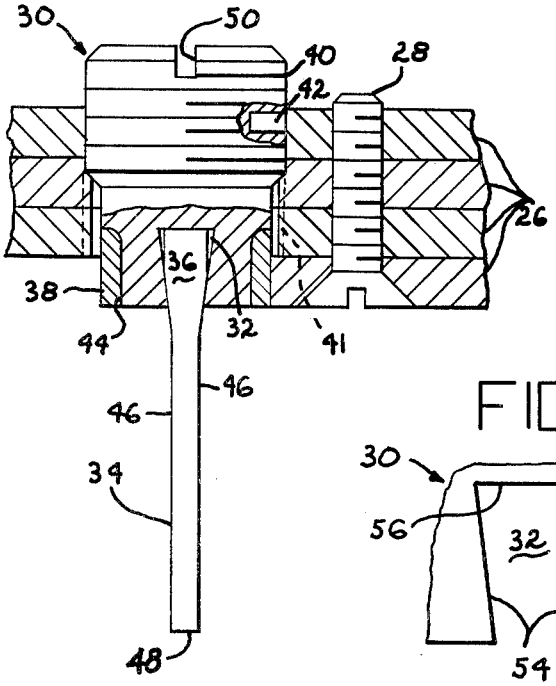
FIG. 3 is an enlarged cut away view of a stator assembly mounted in the housing of a machine.

Shown in FIG. 3 is an enlarged cut away view of the details of mounting the stators or pulverizer blade assemblies in the housing 12 on plates 26 of pulverizing machine 10. As mentioned before, plates 26 are combined so as to form a housing structure 12, the various plates 26 being held in stacked relationship by threaded screw element 28. A pulverizer blade assembly, in this instance used as a stator assembly, is shown comprising a plug member 30 having a slot 32 formed therein.

A hard wear resistant blade member 34 is shown with one end 36 disposed in the slotted portion 32 of plug member 30. A collar member 38 is placed around the periphery of the slotted portion 32 so as to provide a clamping force on one end 36 of blade 34 to hold the blade 34 in assembled relation with plug member 30.

Preferably, the plug member 30 has threads 40 formed thereon so that it may be threadedly connected in a threaded perforation 41 formed in the housing 12. This type of threaded connection makes the stator or pulverizer blade assembly easily replaceable. In order to hold the pulverizer blade assembly in a correct orientation when threaded into the housing 12, a nylon type of interference plug 42 is carried on the threaded portion of the plug member 30 so that a slide interference between the threads 40 and 41 will produce frictional resistance to rotational movement.

The collar 38 is preferably made of a metal material and is preferably shrunk fit over the periphery of the slotted portion 32 of plug member 30 in order to provide the necessary clamping force. As will be noted in FIG. 3, a peripheral undercut 44 is provided on the slotted end portion of plug member 30 so that, when collar 38 is fitted thereover, plug member 30 will still fit into the threaded perforation 41 in housing 12.

The pulverizer blade 34 is preferably made of a hard wear resistant metal carbide material, such as tungsten carbide, and has a rectangular configuration, the length of which is greater than its width, and is relatively thin in cross section. Near one end of the blade 34, the sides 46 taper outwardly from one another or diverge toward the one end 48 of blade 34. The sides 46 of blade 34, as they intersect the end 48, are substantially parallel as they were near the center of blade 34 before they tapered outwardly.

Also shown in FIG. 3 is a groove 50 which may be used as a screwdriver groove for mounting and dismounting pulverizer blade assembly.

Figure 4:
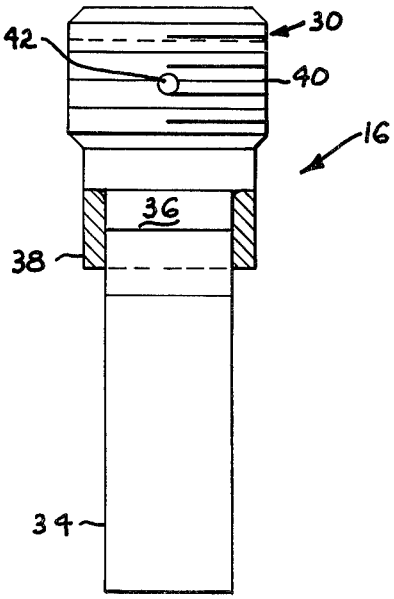
FIG. 4 is a pulverizer blade assembly according to the present invention.

Shown in FIG. 4 is an entire pulverizer blade assembly 16 which is comprised of the plug member 30 having a slotted portion. The pulverizer blade assembly has one end 36 of blade member 34 disposed in the slotted portion and collar 38 is preferably shrunk fit over the periphery of the slotted portion 32 of plug 30 so as to hold blade 34 in assembled relation with plug 30. Nylon plug 42 is shown mounted on the threaded portion 40 of plug 30.

Figure 5:
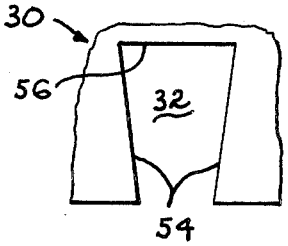
FIG. 5 is an enlarged view of a part of FIG. 3.

Shown in FIG. 5 are further details of the slot 32, slot 32 having opposing faces 54 and a bottom face 56 forming the boundaries of the slot 32. It is preferable that the boundaries 54 taper outwardly from one another or diverge from one another as the depth of slot 32 extends into plug member 30.

Preferably, when the one end 36 of blade 34 has tapered sides 46, then the one end is disposed in slot 32. Cooperating elements of abutment means will be formed between the opposing faces 54 and the tapering sides 46 so that, when the collar 38 is shrunk fit over the periphery of slotted portion 32, the one end 48 will be urged into firm abutment with the bottom face 56 of slot 32.

Modifications may be made within the scope of the appended claims.

What is claimed is:

1. A blade assembly for pulverizing machines comprising; plug means having a slotted portion formed therein, blade means with one end disposed in said slot and another end extending away from said plug, shrinkable collar means for holding said blade and said plug in assembled relation, said walls of said slotted portion tapering outwardly from one another as they extend into said plug, said one end of said blade having sides that taper outwardly from one another as they extend into said plug, said tapering sides and walls forming cooperating elements of abutment means so as to urge said one end of said blade into firm engagement with the bottom of said slotted portion of said plug.

2. A blade assembly according to claim 1 wherein said collar means comprises a cylindrical metal ring extending around the periphery of the slotted portion of said plug means.

3. A blade assembly according to claim 2 wherein said cylindrical metal ring is fitted around the periphery of said slotted portion so as to make said slotted portion of said plug clamp said one end of said blade.

4. A blade assembly according to claim 3 wherein said cylindrical metal ring is shrink fitted around the periphery of said slotted portion.

5. A blade assembly according to claim 4 in which said blade is comprised of a hard wear resistant cemented metal carbide material.

6. A blade assembly according to claim 1 in which said blade is comprised of a hard wear resistant metal carbide material.

7. The method of making a strong wear resistant blade assembly for pulverizing machines, said method comprising the steps of forming a plug member with opposing ends, slotting one of said opposing ends of said plug member, disposing one end of a hard wear resistant blade in said slot and tapering the slot and sides of the one end of the blade member and shrink fitting a metal ring over the periphery of said slotted end portion so as to clamp said one end of said blade in said slot.

* * * * *